US009884749B1

(12) United States Patent
Tian et al.

(10) Patent No.: US 9,884,749 B1
(45) Date of Patent: Feb. 6, 2018

(54) SENSOR ASSEMBLY, SECURITY SYSTEM AND PASSENGER CONVEYOR

(71) Applicant: Otis Elevator Company, Farmington, CT (US)

(72) Inventors: LingHao Tian, Shanghai (CN); Qiang Li, Shanghai (CN); XuLei Guo, Shanghai (CN); Jianwei Zhao, Shanghai (CN); ZhaoXia Hu, Hangzhou (CN); Alan Matthew Finn, Hebron, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/659,902

(22) Filed: Jul. 26, 2017

(30) Foreign Application Priority Data

Jul. 29, 2016 (CN) ..... 2016 1 0610014

(51) Int. Cl.

| | |
|---|---|
| ***B66B 29/00*** | (2006.01) |
| ***B66B 29/02*** | (2006.01) |
| ***B66B 29/08*** | (2006.01) |
| ***B66B 25/00*** | (2006.01) |

(52) U.S. Cl.
CPC ..... *B66B 29/005* (2013.01); *B66B 25/003* (2013.01); *B66B 29/02* (2013.01); *B66B 29/08* (2013.01)

(58) Field of Classification Search
CPC ..... B66B 29/005; B66B 29/02
USPC ..... 198/322, 323
See application file for complete search history.

(56) References Cited

U.S. PATENT DOCUMENTS 2,846,045 A * 8/1958 Fowler ..... B66B 29/04 198/323
4,379,289 A * 4/1983 Peek ..... G08B 13/186 250/221
4,669,597 A * 6/1987 Langer ..... B66B 29/02 198/323

(Continued)

FOREIGN PATENT DOCUMENTS

CN 101508398 A 8/2009
CN 201372156 Y 12/2009

(Continued)

OTHER PUBLICATIONS

US PG Pub 2015/0274490 A1, VLAD, Oct. 1, 2015 (Year: 2015).*

*Primary Examiner* — Douglas A Hess
(74) *Attorney, Agent, or Firm* — Cantor Colburn LLP

(57) ABSTRACT

A sensor assembly for a passenger conveying device, a safety system and the passenger conveying device, wherein the sensor assembly comprises an optical fiber disposed along a length of a skirt board of the passenger conveying device; a light source disposed at a first end of the optical fiber, light being incident into the optical fiber; and an optical receiver disposed at the first end of the optical fiber, the optical receiver receiving backwards scattered light from the optical fiber and being capable of sensing a signal indication of the backwards scattered light, wherein the optical fiber is associated with a sensing element such that the sensing element causes deformation of the optical fiber when the sensing element is subjected to pressure, and the optical receiver is capable of sensing a change in the signal indication of the backward scattered light caused by the deformation of the optical fiber.

24 Claims, 3 Drawing Sheets

(56) References Cited

U.S. PATENT DOCUMENTS 4,896,759 A * 1/1990 Badstuebner ..... B66B 29/04 198/324
4,976,345 A 12/1990 Adrian et al.
5,001,459 A * 3/1991 Jacoby ..... B66B 29/04 198/323
5,245,315 A * 9/1993 Johnson ..... B66B 29/04 198/323
5,366,060 A * 11/1994 Johnson ..... B66B 29/04 198/323
5,842,554 A * 12/1998 Stoxen ..... B66B 25/00 198/322
5,923,005 A 7/1999 Blondiau et al.
6,152,279 A * 11/2000 Davis ..... B66B 29/04 198/323
6,267,219 B1 * 7/2001 Spannhake ..... B66B 27/00 198/322
6,334,522 B2 1/2002 Haruta et al.
6,425,472 B1 * 7/2002 Davis ..... B66B 29/04 198/323
6,595,344 B1 * 7/2003 Davis ..... B66B 29/04 198/323
7,404,476 B2 7/2008 Yoshida
7,482,771 B2 * 1/2009 Hahn ..... G05B 19/19 187/209
7,597,181 B2 * 10/2009 Illedits ..... B66B 29/06 198/325
7,753,190 B2 * 7/2010 Matheisl ..... B66L 323/22 198/323
8,205,735 B2 * 6/2012 Behan ..... B66L 329/005 198/323
8,384,337 B2 * 2/2013 Jahkonen ..... B66L 325/00 198/321
8,847,523 B2 * 9/2014 Bringold ..... H02P 3/04 303/124
9,457,995 B2 * 10/2016 Makovec ..... B66L 323/14
9,475,676 B2 * 10/2016 Ischganeit ..... B66L 329/06
9,731,904 B2 * 8/2017 Raassina ..... B66L 325/006

FOREIGN PATENT DOCUMENTS

CN 102642762 A 8/2012
CN 102963806 A 3/2013
JP H1087254 A 4/1998
JP 3816331 B2 8/2006
JP 2011011901 A 1/2011
JP 4771703 B2 9/2011
WO 2011037564 A1 3/2011

* cited by examiner

SENSOR ASSEMBLY, SECURITY SYSTEM AND PASSENGER CONVEYOR

PRIORITY

This application claims priority to Chinese Patent Application No. 201610610014.4, filed Jul. 29, 2016, and all the benefits accruing therefrom under 35 U.S.C. §119, the contents of which in its entirety are herein incorporated by reference.

FIELD OF THE INVENTION

The present invention relates to the field of safety of passenger conveying devices. Specifically, the present invention relates to a sensor assembly for a passenger conveying device, a safety system having such a sensor assembly and the passenger conveying device, wherein the passenger conveying device includes any device that is provided with a skirt board, such as an escalator or a moving sidewalk or the like.

BACKGROUND OF THE INVENTION

Passenger conveying devices such as escalators and moving sidewalks have already been widely applied to various public places such as shopping malls and airports, and the like. With respect to the passenger conveying devices, safety is a crucial factor forever. All relatively moving parts in the passenger conveying device may cause injuries to people such as pinch injuries. In the passenger conveying device, generally there is a gap between a skirt board and a foot board which move relatively. This gap is generally smaller than 4 mm. Clothes, shoes and the like are easily clamped into the gap. Passengers especially children who take the passenger conveying device are also possibly clamped. This will cause injuries to the passengers taking the passenger conveying device and may also cause damages to the components of the passenger conveying device itself.

A skirt board brush of the passenger conveying device is also called as a skirt board anti-clamping device and can effectively prevent foreign matters from entering the gap between the skirt board and the foot board. However, the skirt board brush cannot fully avoid accidents caused by the fact that the foreign matters enter the gap between the skirt board and the foot board. The skirt board brush cannot trigger countermeasures and the passenger conveying device cannot be braked in time to reduce losses caused by the accidents as much as possible under a situation in which the foreign matters are clamped into the gap between the skirt board and the foot board.

SUMMARY OF THE INVENTION

The purpose of the present invention is to solve or alleviate the defects in the prior art.

According to one aspect of the present invention, there is provided a sensor assembly for a passenger conveying device, comprising:

an optical fiber disposed along a length of a skirt board of the passenger conveying device;

a light source disposed at a first end of the optical fiber, light of the light source being incident into the optical fiber; and an optical receiver disposed at the first end of the optical fiber, the optical receiver receiving backwards scattered light from the optical fiber and being capable of sensing a signal indication of the backwards scattered light, wherein the optical fiber cooperates with a sensing element disposed along the skirt board such that the sensing element causes deformation of the optical fiber when the sensing element is subjected to a pressure, and the optical receiver is capable of sensing a change in the signal indication of the backward scattered light caused by the deformation of the optical fiber.

According to another aspect of the present invention, there is provided a safety system for a passenger conveying device and a passenger conveying device.

DESCRIPTION OF THE DRAWINGS

By referring to the drawings, the above-mentioned and other features of the present invention will become obvious, wherein.

DETAILED DESCRIPTION OF THE EMBODIMENTS

Figure 1:
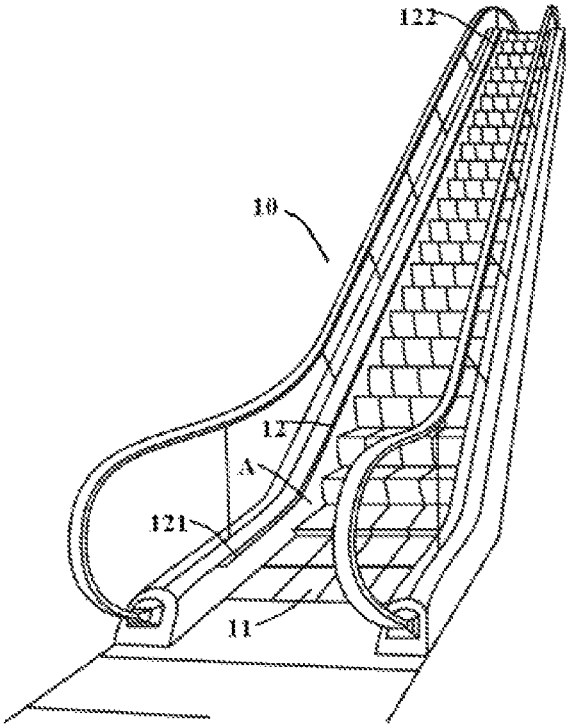
FIG. 1 illustrates a perspective view of an escalator.

It can be easily understood that one skilled in the art may put forward a plurality of interchangeable structural forms and implementation modes according to the technical solution of the present invention without changing the essential spirit of the present invention. Therefore, the following detailed description and drawings are only used for exemplarily describing the technical solution of the present invention, and shall not be viewed as all of the present invention or be viewed as limitations or restrictions to the technical solution of the present invention.

Orientation terms such as "above", "below", "left", "right", "front", "rear", "front side", "back side", "top" and "bottom" and the like which are mentioned or are possibly mentioned in the specification are defined relative to configurations shown in the drawings. They are relative concepts and thus they may be correspondingly changed according to different locations and different use states. Therefore, these or other orientation terms shall not be explained as restrictive terms.

In this text, the passenger conveying device refers to a device such as an escalator or a moving sidewalk or the like.

Firstly, reference is made to FIG. 1 which illustrates an escalator 10. Although an escalator having an ascending or descending function is taken as an example in the drawing and the detailed description below, the sensor assembly and the safety system provided by the present invention may also be applied to moving sidewalks that are commonly seen in airports and large supermarkets and are used for assisting pedestrians in advancing on flat surfaces or surfaces with certain slopes or any passenger conveying device having a skirt board and a foot board which move relatively.

The escalator 10 generally comprises step boards and handrails on two sides of the step boards. Major components comprise the step boards, a traction chain, sprockets, a guide rail system, a main transmission system, a step board tensioning system, a handrail system, etc. The escalator 10 illustrated in FIG. 1 comprises step boards 11 which ascends or descends and continuously and cyclically move and skirt boards 12 which are provided at bottoms of two sides of the step boards 11 of the escalator 10. The skirt boards 12 substantially extend to an upper side from a lower side of the escalator along a moving direction of the step boards 11 and each have a first end 121 or a lower end and a second end 122 or an upper end. In this text, an extending direction of the skirt boards 12 along the escalator 10 is called as a length direction of the skirt boards 12. Along the length direction of the skirt boards 12, there is a gap or a dangerous area A between each step board 11 and each skirt board 12 of the escalator 10, and there are relatively moving parts, i.e., moving step boards 11 and stationary skirt boards 12, in this gap or dangerous area A. Clothes, shoes and the like are easily clamped into this gap or dangerous area A, and even passengers especially children who take the escalator are possibly pinched.

Figure 2:
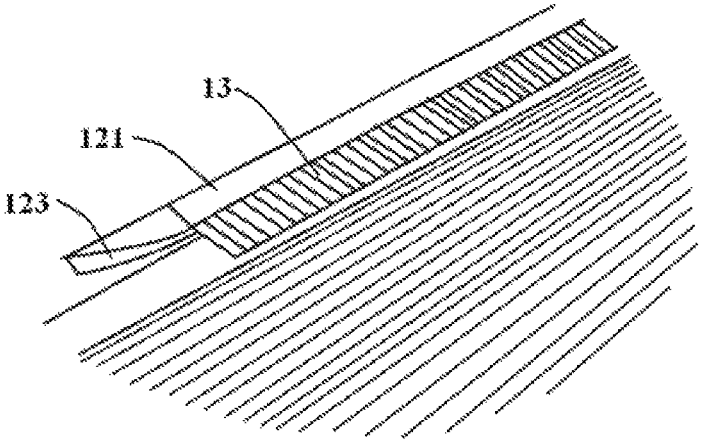
FIG. 2 illustrates an enlarged view of a skirt board area of the escalator in FIG. 1.

FIG. 2 illustrates an enlarged view of a skirt board in FIG. 1. As illustrated in FIG. 2, at the first end 121 or the lower end of the skirt board 12, i.e., the lower side of the escalator 10 illustrated in FIG. 1, the skirt board 12 may be provided to have a groove 123, a skirt board brush 13 extending from the groove 123 is used for preventing foreign matters from being clamped into the above-mentioned gap or dangerous area A, so as to prevent accidents from occurring. The skirt board brush may consist of a fur brush or a rubber brush and the like. In some embodiments, the skirt board brush has a certain strength, for example, the skirt board brush consists of a compact plastic strip fur brush, especially a nylon brush. In some embodiments, the skirt board brush has characteristics such as high flexibility, high resilience, strong elasticity and wear resistance, and the like. Although the design of the skirt board brush 13 can prevent foreign matters from being entangled to a certain extent, the skirt board brush 13 cannot fully preclude this risk alone, cannot prompt passengers to get far away from this gap or dangerous area A and cannot trigger countermeasures in time when this type of accidents occur.

Figure 3:
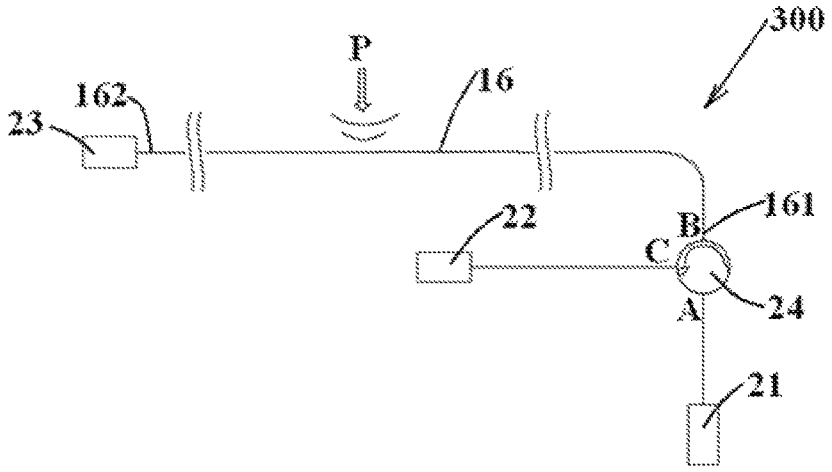
FIG. 3 illustrates a structural schematic view of a sensor assembly for a passenger conveying device according to one embodiment of the present invention.

Now, reference is made to FIG. 3 which illustrates a sensor assembly 300 for a passenger conveying device according to one embodiment of the present invention. The sensor assembly 300 comprises an optical fiber 16 disposed along the length of the skirt board 12 of the passenger conveying device such as the escalator 10 in FIG. 1, and specifically comprises an optical fiber 16 disposed along an entire length or a partial length of the skirt board 12. As known in the art, optical fiber is also called as a light guide fiber, which may be made of glass or plastic or the like and may be used as a light-conducting element, and a transmission principle is total reflection of light. A light source 21 may be disposed at a first end 161 of the optical fiber 16, incident light emitted by the light source 21 is incident into the first end 161 of the optical fiber 16, for example, through an optical circulator 24, and the incident light is incident into the optical fiber 16 substantially along a length direction of the optical fiber 16. The sensor assembly 300 further comprises an optical receiver 22 disposed at the first end 161 of the optical fiber 16, and the optical receiver 22 is used for receiving backwards scattered light from the optical fiber and is capable of sensing a signal indication of the backwards scattered light, such as an amplitude of the backwards scattered light, and the like. When the optical fiber 16 is deformed under pressure, based on Rayleigh scattering and Fresnel reflection, backwards scattered light will be produced in the optical fiber 16. The optical fiber 16 cooperates with a sensing element disposed along the skirt board 12 such that the optical fiber 16 is deformed when the sensing element is subjected to a pressure, and the optical receiver 22 is capable of sensing a change in the signal indication of the backward scattered light caused by the deformation of the optical fiber 16. In view of the propagation speed of light, the sensor assembly 300 according to the embodiment of the present invention has a very high feedback speed.

In one specific embodiment, the sensor assembly 300 further comprises an optical circulator 24 disposed at the first end 161 of the optical fiber 16, the optical circulator 24 comprises a port A, a port B and a port C, incident light emitted by the light source 21 enters the optical circulator 24 from the port A of the optical circulator 24 and is incident into the first end 161 of the optical fiber 16 from the port B of the optical circulator 24, the backwards scattered light returned along the optical fiber 16 enters the optical circulator 24 from the port B of the optical circulator 24 and is emergent from the port C of the optical circulator 24, and the optical receiver 22 is communicated with the port C of the optical circulator to receive the backwards scattered light.

In one embodiment, a second end 162 of the optical fiber 16 is inserted into a beam dump 23 so as to prevent reflected light from being produced at the second end 162 of the optical fiber 16 and interfering the backwards scattered light. Preferably, the beam dump 23 has a refractive index which is substantially the same as a refractive index of the optical fiber 16 such that surface reflection at the second end 162 of the optical fiber is minimized. In one embodiment, the beam dump 23 can be made of a polymer material such as vinylidene fluoride. In one embodiment, two types of polymers may be used and mixed for manufacturing the beam dump 23 and a proportion of each polymer material in the mixture may be adjusted such that the mixture has a refractive index close to the refractive index of the optical fiber 16. Since only the beam dump is provided at the second end of the optical fiber 16 of the sensor assembly 300 according to the embodiment of the present invention, the optical fiber 16 of the sensor assembly 300 may extend for any length to applicable to various specifications or sizes of passenger conveying devices or the optical fiber 16 can extend freely along any portion of the length of the skirt board.

In one embodiment, the optical fiber 16 is substantially disposed along the entire length of the skirt board 12. For example, with respect to the escalator 10 illustrated in FIG. 1, the optical fiber 16 extends from the first end 121 of the skirt board 12 to the second end 122 of the skirt board 12. Specifically, the first end 161 of the optical fiber 16 and components such as the light source 21, the optical circulator 24 and the optical receiver 22 related thereto and the like may be disposed at a position near any one of the first end 121 or the second end 122 of the skirt board 12 and are covered by a housing, and the second end 162 of the optical fiber can extend for any length along the skirt board 12. Of course, in an alternative embodiment, the optical fiber 16 may only extend along a portion of the length of the skirt board 12, for example, only extend along a straight portion of a middle portion of the skirt board 12.

Figure 4:
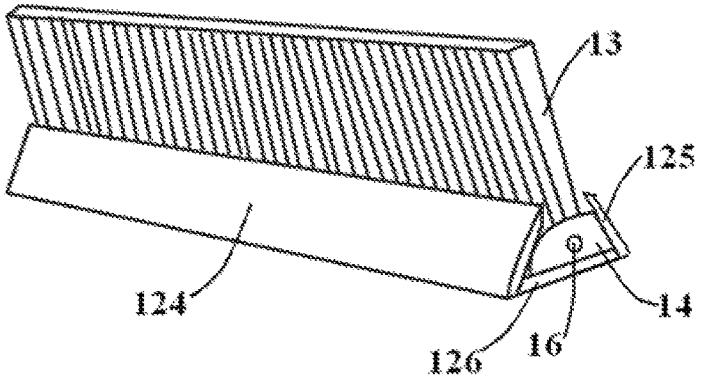
FIG. 4 illustrates a structural view of a skirt board according to one embodiment of the present invention.
Figure 5:
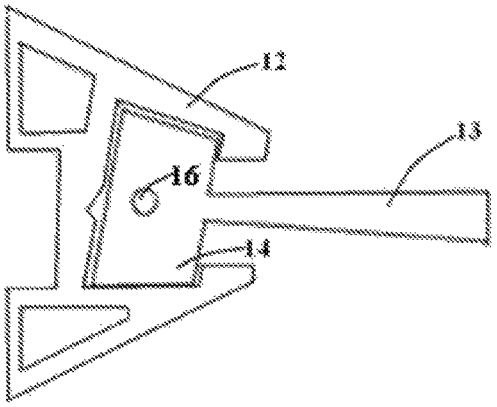
FIG. 5 illustrates a sectional view of a skirt board according to one embodiment of the present invention.

Please refer to FIG. 4 and FIG. 5, two embodiments in which the optical fiber is disposed along the skirt board are illustrated. In the embodiment illustrated in FIG. 4, the skirt board comprises a first side board 124, a second side board 125 and a bottom board 126. The first side board 124, the second side board 125 and the bottom board 126 jointly define a groove, and the optical fiber 16 wrapped with an elastic material body 14 is disposed in the groove. This groove may have a section which is in a triangular shape.

In FIG. 5, the skirt board 12 is integrally formed and defines a notch, the notch defines an opening having a reduced width, a hook is formed at the opening and the optical fiber 16 wrapped with the elastic material body 14 is embedded into the notch. In some embodiments, as known in the art, the skirt board may be made of an aluminum alloy material through extrusion molding. It should be understood that the shape of the skirt board is not limited to that illustrated in the drawings.

In one embodiment, the optical fiber 16 is wrapped with the elastic material body 14 such that the optical fiber 16 is capable of being restored to an original state, for example, a straight state, under a situation in which there is no pressure or the pressure is released. Under the situation in which the optical fiber 16 is in a straight state, there is no or only a very small signal indication such as an amplitude of the backwards scattered light. At this moment, as long as the optical fiber 16 is deformed under pressure, the amplitude of the backwards scattered light is incisively changed. In some embodiments, the skirt board may have curved portions on the upper side and the lower side of the escalator. At this moment, the optical fiber 16 embedded into the skirt board may also produce a certain of curvatures. This will cause a situation in which the optical fiber 16 is not in a fully straight state when it is not subjected to an external force. At this moment, the optical receiver will also receive a certain amplitude of the backwards scattered light when the optical fiber 16 is not subjected to the external force, and the value of the amplitude may be called as a background value.

In some embodiments, the groove defines an opening having a reduced width. The optical fiber 16 wrapped by the elastic material body 14 may be pressed into the groove, and the groove having a gradually reduced opening prevents the optical fiber 16 wrapped with the elastic material body 14 from falling out. The elastic material body 14 may be made of a material selected from a group consisting of various suitable materials, and these materials have a certain elasticity to facilitate installation and can transfer the pressure acting on the sensing element to the optical fiber 16. As one specific embodiment, a material for making the elastic material body 14 may be rubber.

The sensing element has a contact end, which is disposed at a position near the above-mentioned gap or dangerous area A to be in direct contact with a pressure source, for example, in contact with a foreign matter in an area of the skirt board, so as to sense the existence of the foreign matter. The sensing element may be directly connected to the optical fiber 16 or indirectly connected to the optical fiber 16, for example, indirectly connected to the optical fiber 16 through connection to the elastic material body 14. The sensing element may be continuous or discontinuous along the optical fiber 16. For example, in one embodiment, the sensing element may be a rod made of a plastic material and is directly connected to the optical fiber 16 at a certain interval or is connected into the elastic material body 14 which wraps the optical fiber 16. In one embodiment, the skirt board brush 13 may be used as the sensing element, and one end of the skirt board brush 13 used as the sensing element is connected to the optical fiber 16 or connected to the elastic material body 14 which wraps the optical fiber 16. It should be understood that the sensing element is not limited to the above-mentioned specific embodiment, and the sensing element may be any components which is capable of sensing force due to the existence of a foreign matter in the dangerous area A, directly or indirectly transferring the force to the optical fiber 16 and causing the deformation of the optical fiber 16.

Figure 6:
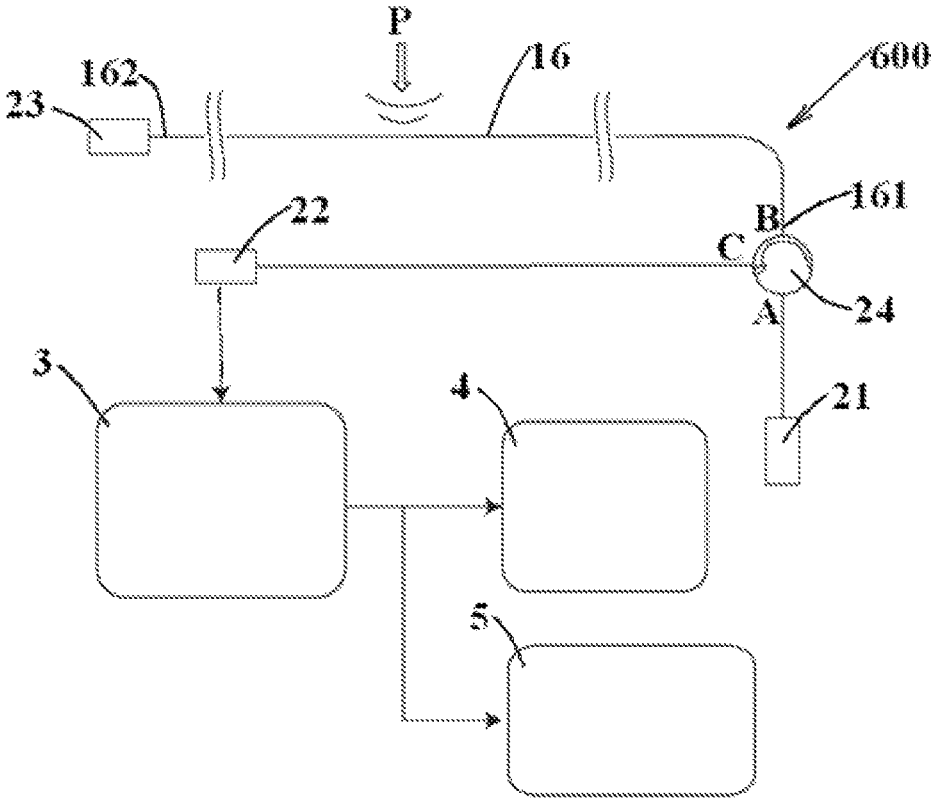
FIG. 6 illustrates a structural schematic view of a safety system for a passenger conveying device according to one embodiment of the present invention.

Referring to FIG. 6, there is further provided a safety system 600 for a passenger conveying device. The safety system 600 comprises the sensor assembly according to various embodiments of the present invention, an analysis unit 3 connected with the sensor assembly, and an executing mechanism connected with the analysis unit 3. The optical receiver of the sensor assembly may be further connected or communicated with the analysis unit 3, or the analysis unit 3 may be integrated with the optical receiver. The analysis unit 3 may directly perform a processing based on the signal indication such as information about the amplitude of the backwards scattered light sensed by the optical receiver or perform a processing by converting the information about the amplitude of the backwards scattered light into information about the pressure acting on the sensing element, and operate the executing mechanism based on the information about the amplitude of the backwards scattered light or the information about the pressure.

In one embodiment, when the optical fiber 16 is not subjected to a pressure, the amplitude of the backwards scattered light is $W_0$, e.g., $W_0$ is zero or a background value; when a pressure P is applied to the sensing element and thereby acts on the optical fiber 16, the amplitude of the backwards scattered light becomes $W_1$, a change in the amplitude of the backwards scattered light is $\Delta W=W_1-W_0$, and the analysis unit 3 may determine countermeasures based on the change $\Delta W$ in the amplitude of the backwards scattered light. It needs to be noted that the change $\Delta W$ in the amplitude of the backwards scattered light reflects a degree of curvature of the optical fiber, and the degree of curvature of the optical fiber further reflects a change in the pressure acting on the sensing element connected with the optical fiber, i.e., $\Delta P=P_1-P_0$. In another aspect, the sensed amplitude of the backwards scattered light may also be converted into the pressure acting on the sensing element. For example, the amplitude $W_0$ of the backwards scattered light corresponds to the pressure $P_0$, the amplitude $W_1$ of the backwards scattered light corresponds to the pressure $P_1$ and the analysis unit 3 may determine the countermeasures based on the value of the change in the pressure, i.e., $\Delta P=P_1-P_0$.

The performance of the analysis unit 3 can be improved by increasing the effective amount of the backwards scattered light. In one embodiment, the effective amount of the light may be increased through pulse compression, wherein the transmitted (incident) light is modulated. For example, on-off modulation is adopted through a pseudorandom pattern. In addition, the analysis unit associates a transmitted pattern with a received pattern. There are various effective modulation technologies and the specifically selected modulation mode is not used for the purpose of limitation.

In one embodiment, a distance to a position at which the backwards scattered light is produced or the light source along the optical fiber may be determined by calculating a difference between the transmitted signal and the received signal. This distance is a distance corresponding to half of round-trip time of light transmitted at light speed in the optical fiber. A method for measuring a time difference is to measure a phase of the transmitted signal relative to the received signal. This time delay is in proportion to a phase difference of light frequency. Since possibly this is very difficult to directly measure and possibly there is a fuzzy result, it is advantageous to modulate light by using one or more low frequencies and to measure the phase difference at these frequencies. There are various effective modulation technologies and the specifically selected modulation mode is not used for the purpose of limitation.

In one embodiment, the executing mechanism may comprise an alarm device 4, such that the alarm device 4 is started when the signal indication of the backwards scattered light, e.g., the change in the amplitude of the backwards scattered light $\Delta W$ or the change in the pressure $\Delta P$ is greater than $W_A$ or $P_A$, so as to alert passengers to get far away from the dangerous area between the skirt board and the foot board. The alarm device 4 may comprise an alarm ring and/or an alarm lamp. For example, the alarm lamp may be a single lamp or a lamp strip provided along upper edge of the skirt board. In one embodiment, the executing mechanism comprises a control device 5. The control device 5 enables the passenger conveying device to be slowed down or rapidly or stably braked when the change in the amplitude of the backwards scattered light $\Delta W$ or the change in the pressure $\Delta P$ is greater than $W_S$ or $P_S$, and the control device 5 may slow down or brake the escalator in time when an accident occurs or possibly occurs, so as to reduce the loss to a minimum. The executing mechanism is not limited to the above-mentioned alarm device 4 and the control device 5, and the executing mechanism may further comprise other devices to execute suitable countermeasures such as giving an alarm and calling an ambulance car, and the like.

In one embodiment, since the distance to the position at which the backwards scattered light is produced or the light source is measured and the alarm device is distributed along the length of the escalator, the alarm device near the point at which the backwards scattered light is produced may be selectively activated. By adopting this mode, more specific feedbacks may be given to people who get close to positions at which problems occur.

It should be understood that the safety system according to the present invention may be used in combination with other safety systems of the passenger conveying device. For example, the safety system according to the present invention may also be incorporated into an imaging sensor and/or a depth sensing sensor for monitoring the passenger conveying device, such that monitoring personnel can observe the situation on the scene at the earliest time to take necessary measures such as giving an alarm or calling an ambulance car and the like when an accident occurs. Similarly, in an embodiment in which the distance to the light source of the backwards scattered light can be obtained, more specific indications may be adopted. For example, collimation marks may be used for indication in a video monitoring system.

In some embodiments, the safety system according to the present invention may comprise two independent sensor assemblies. The two sensor assemblies may be disposed along the skirt boards on two sides of the passenger conveying device. The two sensor assemblies may be connected to the same analysis unit 3 and the analysis 3 is further connected to the executing mechanism comprising the alarm device 4 and the control device 5.

The present invention further provides a passenger conveying device. The passenger conveying device comprises the safety system for the passenger conveying device according to various embodiments of the present invention, and the passenger conveying device may be an escalator, a moving sidewalk or the like.

The sensor assembly according to some embodiments of the present invention may sense a situation in which a foreign matter is clamped in the gap between the skirt board and the foot board at the earliest time and take countermeasures in time. Some embodiments of the present invention further provide a safety system and a passenger conveying device, which can prompt passengers to not get close to the dangerous area between the skirt board and the foot board of the escalator. In another aspect, some embodiments of the present invention further provide a safety system and a passenger conveying device, which can trigger countermeasures in time when a dangerous accident that a foreign matter mistakenly enters between the skirt board and the foot board of the escalator, so as to reduce injuries and losses. In another aspect, the sensor assembly according to some embodiments of the present invention does not cause any harm to passengers since a light intensity is very low.

It should be understood that all above-mentioned embodiments are just exemplary and are not restrictive. Various modifications or variations made by one skilled in the art to the above-described specific embodiments under the concept of the present invention shall be all included in the legal protection scope of the present invention.

What is claimed is:

1. A sensor assembly for a passenger conveying device, characterized in that the sensor assembly comprises:

an optical fiber disposed along a length of a skirt board of the passenger conveying device;

a light source disposed at a first end of the optical fiber, light of the light source being incident into the optical fiber; and an optical receiver disposed at the first end of the optical fiber, the optical receiver receiving backwards scattered light from the optical fiber and being capable of sensing a signal indication of the backwards scattered light, wherein the optical fiber is associated with a sensing element such that the sensing element causes deformation of the optical fiber when the sensing element is subjected to a pressure, and the optical receiver is capable of sensing a change in the signal indication of the backward scattered light caused by the deformation of the optical fiber.

2. The sensor assembly according to claim 1, characterized in that the sensing element is provided along the skirt board.

3. The sensor assembly according to claim 1, characterized in that the light source is capable of emitting modulation light, the sensor assembly further comprises an analysis unit and the analysis unit enables the emitted light to be associated with received light for calculating a distance to the light source of the backwards scattered light along the optical fiber.

4. The sensor assembly according to claim 1, characterized in that the sensor assembly further comprises an optical circulator provided at the first end of the optical fiber, the optical circulator comprises a port A, a port B and a port C, incident light emitted by the light source enters from the port A of the optical circulator and is incident into the first end of the optical fiber from the port B of the optical circulator, the backwards scattered light returned from the optical fiber enters from the port B of the optical circulator and is emergent from the port C of the optical circulator, and the optical receiver is communicated with the port C of the optical circulator to receive the backwards scattered light.

5. The sensor assembly according to claim 1, characterized in that the sensing element is a skirt board brush and one end of the skirt board brush is directly or indirectly connected with the optical fiber.

6. The sensor assembly according to claim 1, characterized in that the optical fiber extends along an entire length of the skirt board.

7. The sensor assembly according to claim 1, characterized in that the optical fiber extends along a straight portion of the skirt board.

8. The sensor assembly according to claim 1, characterized in that the optical fiber is disposed in a groove defined by the skirt board.

9. The sensor assembly according to claim 1, characterized in that the optical fiber is wrapped with an elastic material body.

10. The sensor assembly according to claim 9, characterized in that the sensing element is a skirt board brush, one end of the skirt board brush is connected with the elastic material body and the elastic material body together with the wrapped optical fiber is embedded into a groove defined by the skirt board.

11. The sensor assembly according to claim 9, characterized in that the skirt board defines a groove with an opening having a gradually reduced width to prevent the elastic material body from falling out.

12. The sensor assembly according to claim 9, characterized in that the elastic material body is made of rubber.

13. The sensor assembly according to claim 1, characterized in that a beam dump is provided at a second end of the optical fiber.

14. The sensor assembly according to claim 13, characterized in that the beam dump is made of a polymer material and the polymer material has a refractive index which is substantially the same as a refractive index of the optical fiber.

15. The sensor assembly according to claim 14, characterized in that the beam dump is made of vinylidene fluoride.

16. A safety system for a passenger conveying device, characterized in that the safety system comprises:

the sensor assembly according to claim 1;

an analysis unit connected with the sensor assembly; and an executing mechanism connected with the analysis unit.

17. The safety system according to claim 16, characterized in that the analysis unit operates the executing mechanism based on a change in a signal indication of backwards scattered light fed back by the optical receiver.

18. The safety system according to claim 17, characterized in that the executing mechanism comprises an alarm ring and/or an alarm lamp.

19. The safety system according to claim 18, characterized in that the executing mechanism is operated depending on or partially depending on the calculated distance to the light source of the backwards scattered light.

20. The safety system according to claim 17, characterized in that the executing mechanism comprises a control device and the control device is capable of enabling the passenger conveying device to be slowed down or braked.

21. The safety system according to claim 16, characterized in that the analysis unit converts the change in the signal indication of the backwards scattered light fed back by the optical receiver into a change in a pressure to which the sensing element is subjected and operates the executing mechanism based on the change in the pressure.

22. The safety system according to claim 21, characterized in that the analysis unit further operates the executing mechanism based on a distance to the light source of the backwards scattered light.

23. The safety system according to claim 16, characterized in that the safety system further comprises an imaging sensor and/or a depth sensing sensor for monitoring the passenger conveying device.

24. A passenger conveying device, characterized in that the passenger conveying device comprises the safety system according to claim 16.

* * * * *